United States Patent [19]

Barditch

[11] Patent Number: 4,704,942

[45] Date of Patent: Nov. 10, 1987

[54] CHARGED AEROSOL

[76] Inventor: Irving F. Barditch, 4007 Rosecrest Ave., Baltimore, Md. 21215

[21] Appl. No.: 892,566

[22] Filed: Aug. 1, 1986

[51] Int. Cl.[4] ..... F41H 11/00; F41H 13/00

[52] U.S. Cl. ..... 89/1.11; 102/367; 239/2.1; 239/3

[58] Field of Search ..... 89/1.11; 102/367; 222/3; 239/14.1, 2.1, 3

[56] References Cited

U.S. PATENT DOCUMENTS

| | | | |
|---|---|---|---|
| 1,225,521 | 5/1917 | Steinmetz | 89/1.11 X |
| 3,313,487 | 4/1967 | Merrill | 239/14.1 |
| 3,374,708 | 3/1968 | Wall | 89/1.11 |
| 3,545,677 | 12/1970 | Power et al. | 239/2.1 |
| 3,992,628 | 11/1976 | Karney | 89/1.11 X |
| 4,475,927 | 10/1974 | Loos | 239/3 X |
| 4,545,525 | 10/1985 | Sacher et al. | 239/3 |

*Primary Examiner*—David H. Brown

*Attorney, Agent, or Firm*—Anthony T. Lane; Harold H. Card, Jr.; Michael C. Sachs

[57] ABSTRACT

A method of defending against a warfare cloud of toxic aerosol utilizes a charged defensive aerosol which is sprayed into the cloud. The defensive aerosol is made of a defensive agent which may be chemically or biologically active. The agent is sprayed through charged nozzles to impart a charge to the aerosol. The charge should be at least several thousands of volts with respect to ground so that particles of the defensive aerosol combine and coagulate with particles of the toxic aerosol to neutralize and cause rapid settling of the warfare cloud.

7 Claims, 1 Drawing Figure

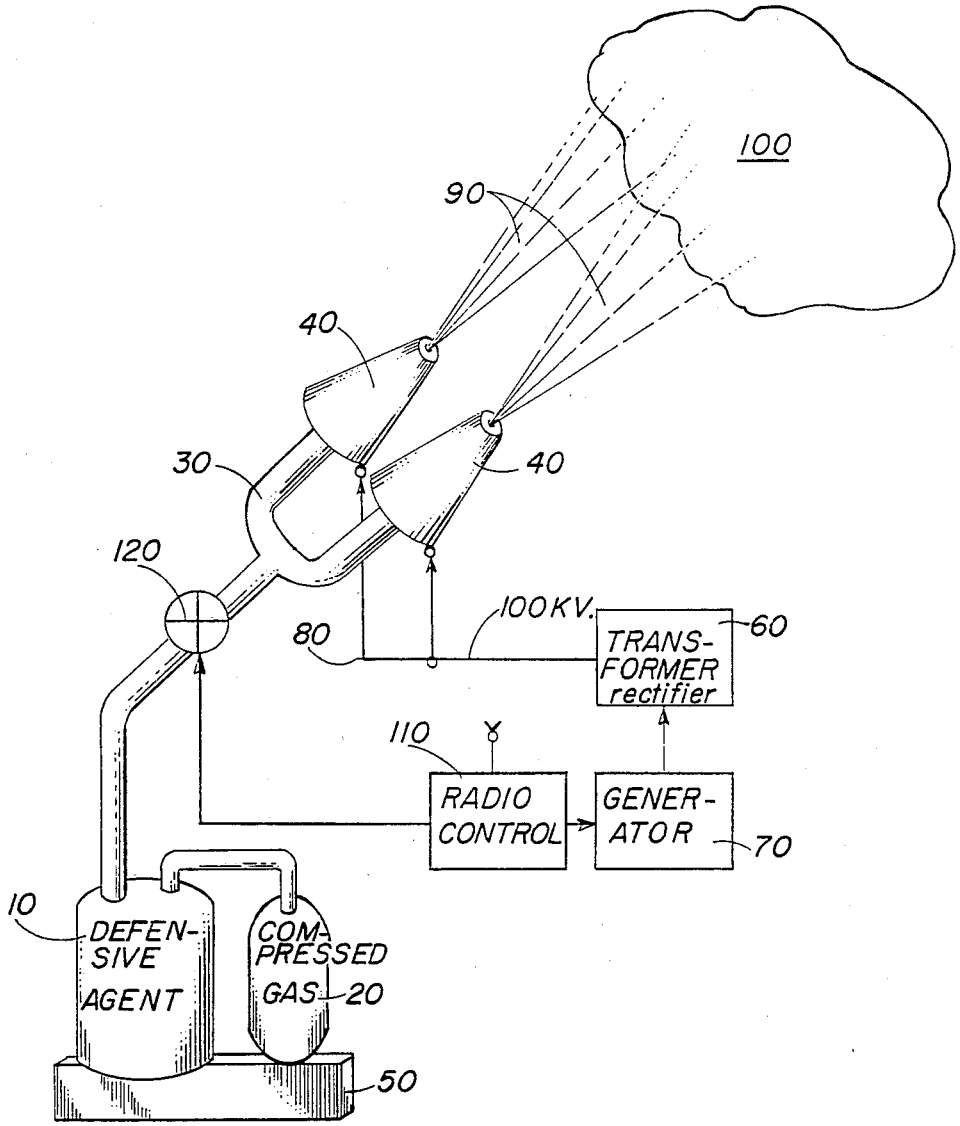
100
90
40
40
30
120
100KV.
80
TRANS-
FORMER
rectifier
60
110
RADIO
CONTROL
GENER-
ATOR
70
10
DEFEN-
SIVE
AGENT
COM-
PRESSED
GAS
20
50

CHARGED AEROSOL

GOVERNMENTAL INTEREST

The invention described herein may be manufactured, used and licensed by or for the Government for Governmental purposes without the payment to me of any royalties thereon.

FIELD AND BACKGROUND OF THE INVENTION

The present invention relates in general to aerosols and in particular to a new and useful method of neutralizing a toxic or otherwise dangerous target aerosol using a defensive barrier comprising a highly charged defensive aerosol.

Chemical and biological warfare involves the dispersion of an aerosol cloud containing the toxic chemical or biological agent over an area to be attacked.

Defense of that area from the aerosol cloud poses a difficult technical problem.

SUMMARY OF THE INVENTION

The present invention is drawn to a defensive method against such chemical or biological warfare cloud.

According to the invention, a barrier of defensive aerosol is dispersed into the warfare cloud. The defensive aerosol may include components which neutralize or kill the biological agent, or which neutralize the toxic chemical. The defensive barrier also increases the rate at which the warfare cloud settles to remove the warfare cloud from the atmosphere.

To this end, the defensive aerosol is electrostatically charged to a high voltage potential. This causes attraction between the particles of the defensive aerosol and the particles of the warfare cloud. This forms larger particles which settle more rapidly. By including chemically neutralizing and/or disinfective additives to the defensive aerosol, the chemical or biological aerosol can be neutralized or killed once particles of the warfare cloud combine with particles of the defensive aerosol.

Accordingly an object of the present invention is to provide a method of defending against a warfare cloud of toxic aerosol comprising charging a defensive aerosol to at least 10,000 volts and spraying the charged aerosol into the warfare cloud whereby particles of the defensive aerosol combine with particles of the toxic aerosol.

A further object of the invention is to charge the defensive aerosol to at least 100,000 volts and to include in this aerosol neutralizing agents which either neutralize a chemical toxic aerosol or neutralize or kill a biological toxic aerosol.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only drawing in the application is a schematic diagram showing an apparatus which can be used to practice the invention.

DESCRIPTION OF THE PREFERRED EMBODIMENT

Referring to the drawing in particular, a device for defending against a warfare cloud comprises a tank 10 containing a defensive agent such as a chemical for neutralizing toxic chemicals in a warfare cloud, or for killing or neutralizing biological agents of the cloud. A tank of compressed gas 20 is connected to the defensive agent tank 10 for pressurizing tank 10. The defensive aerosol is then supplied over pipes 30 to a pair of nozzles 40. The tanks and nozzles are insulated from ground, for example by providing an insulating layer 50 for supporting the entire assembly. Nozzles 40 are connected to a transformer—rectifier system 60 which is powered by a 60 cycle generator system 70. The generator and transformer—rectifier are both of conventional design. Transformer—rectifier 60 is capable of applying several 10's or 100's of volts (either plus or minus with respect to ground) to connecting lines 80 which are connected to nozzles 40. In this way the aerosol 90 which is discharged from nozzles 40 is at a voltage of at least 10,000, and preferably at least 100,000 volts with respect to ground potential.

In defending against a biological cloud of toxic aerosol, tank 30 may contain a disinfectant such as Lysol (a trade name) or bleach. Any other known disinfectant may be used. The disinfectant is preferably provided in a water solution.

For defending against chemical toxic aerosols an appropriate neutralizing chemical can be used for reducing the toxicity or irritant value of the toxic aerosol.

Whether the aerosol spray 90 is at a plus or minus potential level, it will always be at a voltage which is several thousand volts different from any static charge which may have been accumulated by particles in the target warfare cloud 100. For this reason particles of aerosol 90 will always be attracted to particles of the toxic aerosol in cloud 100 and thus combine with the toxic aerosol forming larger droplets. These larger droplets will thus settle more rapidly. In addition the larger droplets are less likely to penetrate deeply into the respiratory track of personnel exposed to the large droplets.

The electrostatically charged aerosol particles combine with the toxic aerosol particles either by direct attraction or by dipole generation. Coagulation between the two particles can also be taken advantage of by providing a neutralizing chemical in the defensive aerosol. As noted above, this can be a disinfectant for the purpose of defending against biological warfare clouds, or a chemical neutralizing agent for defending against chemically toxic warfare clouds.

A small scale test to confirm the effectiveness of the invention was performed using a Speeflo (a trade name) electrostatic spray gun and a hypochlorite solution in a test chamber. At moderate humidity, the charged spray seemed about 10% more effective on the cloud in the chamber than if spraying took place without a charge. At higher humidity the charged spray was up to 60% more effective. The target was a cloud of *Bacillus subtilis* spores.

In a working embodiment of the invention, a radio control 110 can be used to remotely activate generators 70 and a valve 120 for spraying and charging the aerosol 90. Radio control 110 can be activated by a radio signal when the toxic cloud 100 is first detected.

While a specific embodiment of the invention has been shown and described in detail to illustrate the application of the principles of the invention, it will be understood that the invention may be embodied otherwise without departing from such principles.

What is claimed is:

1. A method of defending against a warfare cloud of toxic aerosol comprising charging a defensive aerosol to at least 10,000 volts and spraying the aerosol into the warfare cloud.

2. A method according to claim 1 including using a neutralizing agent to form the defensive aerosol which chemically neutralizes the toxic aerosol.

3. A method according to claim 1 including a biologically active agent to form the defensive aerosol which biologically neutralizes the toxic aerosol.

4. A method according to claim 3 including using disinfectant as the agent for the defensive aerosol.

5. A method according to claim 1 including charging the defensive aerosol to at least 100,000 volts.

6. A method according to claim 5 including using a disinfectant as the defensive aerosol.

7. A method according to claim 5 including spraying the defensive aerosol through at least one nozzle and charging the nozzle to at least 100,000 volts.

* * * * *